US007101460B2

(12) United States Patent
Liu et al.

(10) Patent No.: US 7,101,460 B2
(45) **Date of Patent: *Sep. 5, 2006**

(54) SOFT PAPER PRODUCT INCLUDING BENEFICIAL AGENTS

(75) Inventors: Kou-Chang Liu, Appleton, WI (US); Roger E. Wendler, Jr., Sherwood, WI (US); Peter J. Allen, Neenah, WI (US); Paul D. Beuther, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/232,577

(22) Filed: Sep. 22, 2005

(65) Prior Publication Data

US 2006/0016570 A1 Jan. 26, 2006

Related U.S. Application Data

(62) Division of application No. 10/305,790, filed on Nov. 27, 2002, now Pat. No. 6,949,168.

(51) Int. Cl.
*D21H 17/13* (2006.01)

(52) U.S. Cl. ..... 162/184; 162/158; 162/135; 162/204; 162/199; 264/466

(58) Field of Classification Search ..... 162/109, 162/158, 135, 183–184, 157.1–157, 157.3, 162/204, 199; 424/400–402; 428/153, 154; 427/391, 361, 331; 264/464, 466
See application file for complete search history.

(56) References Cited

U.S. PATENT DOCUMENTS 2,345,543 A 3/1944 Wohnsiedler et al.
2,926,116 A 2/1960 Keim
2,926,154 A 2/1960 Keim
3,556,932 A 1/1971 Coscia et al.
3,556,933 A 1/1971 Stamford et al.
3,700,623 A 10/1972 Keim
3,722,469 A 3/1973 Bartley et al.
3,772,076 A 11/1973 Keim
3,849,241 A 11/1974 Butin et al.
3,865,078 A 2/1975 De Howitt et al.
3,885,158 A 5/1975 Flutie et al.
3,899,388 A 8/1975 Petrovich et al.
3,905,329 A 9/1975 Cone et al.
3,930,465 A 1/1976 Schuierer
3,965,518 A * 6/1976 Muoio ..... 15/104.93
4,005,028 A 1/1977 Heckert
4,005,030 A 1/1977 Heckert
4,016,831 A 4/1977 James et al.
4,023,526 A 5/1977 Ashmus et al.
4,061,001 A 12/1977 Von Der Eltz et al.
4,081,318 A 3/1978 Wietsma
4,089,296 A 5/1978 Barchi
4,099,913 A 7/1978 Walter et al.
4,118,526 A 10/1978 Gregorian et al.
4,129,528 A 12/1978 Petrovich et al.
4,147,586 A 4/1979 Petrovich et al.
4,158,076 A 6/1979 Wallsten
4,159,355 A 6/1979 Kaufman
4,184,914 A 1/1980 Jenkins
4,193,762 A 3/1980 Namboodri
4,198,316 A 4/1980 Nahta
4,222,921 A 9/1980 Van Eenam
4,230,746 A 10/1980 Nahta
4,237,818 A 12/1980 Clifford et al.
4,263,344 A 4/1981 Radvan et al.
4,276,339 A 6/1981 Stoveken
4,279,964 A 7/1981 Heller
4,288,475 A 9/1981 Meeker
4,297,860 A 11/1981 Pacifici et al.
4,305,169 A 12/1981 Vidalis
4,343,835 A 8/1982 Jones et al.
4,348,251 A 9/1982 Pauls et al.
4,364,784 A 12/1982 Van Wersch et al.
4,366,682 A 1/1983 Keller
4,384,867 A 5/1983 Grüber
4,385,954 A 5/1983 Pauls et al.
4,387,118 A 6/1983 Shelton
4,400,953 A 8/1983 Driessen et al.

(Continued)

FOREIGN PATENT DOCUMENTS

DE 252208 10/1912

(Continued)

OTHER PUBLICATIONS

Article—*Recent Developments in Foam Application Systems*, Gaston County Environmental Systems, 4 pages, undated.

(Continued)

*Primary Examiner*—José A. Fortuna
(74) *Attorney, Agent, or Firm*—Dority & Manning, P.A.

(57) ABSTRACT

A method is disclosed for topical application of compositions containing a chemical additive onto a paper web. The present invention is also directed to paper products formed from the method. In general, the method includes the steps of extruding a composition containing a chemical additive through a melt blown die and then applying the composition to a moving paper web. In particular, the method provides for the application of tacky compositions to a web through a melt blown die while avoiding die tip clogging. In one embodiment, the chemical composition is extruded into fibers and applied to the paper web. The chemical composition may contain, for instance, various additives, such as a polysiloxane softener and one or more beneficial agents.

43 Claims, 6 Drawing Sheets

U.S. PATENT DOCUMENTS

| | | | | |
|---|---|---|---|---|
| 4,402,200 | A | | 9/1983 | Clifford et al. |
| 4,408,996 | A | | 10/1983 | Baldwin |
| 4,426,418 | A | | 1/1984 | Coleman et al. |
| 4,435,965 | A | | 3/1984 | Sasseville et al. |
| 4,440,808 | A | | 4/1984 | Mitter |
| 4,442,771 | A | | 4/1984 | Mitter |
| 4,444,104 | A | | 4/1984 | Mitter |
| 4,453,462 | A | | 6/1984 | Mitter |
| 4,463,467 | A | | 8/1984 | Grüber et al. |
| 4,463,583 | A | | 8/1984 | Krüger et al. |
| 4,474,110 | A | | 10/1984 | Rosner |
| 4,497,273 | A | | 2/1985 | Mitter |
| 4,498,318 | A | | 2/1985 | Mitter |
| 4,501,038 | A | | 2/1985 | Otting |
| 4,502,304 | A | | 3/1985 | Hopkins |
| 4,529,480 | A | | 7/1985 | Trokhan |
| 4,534,189 | A | | 8/1985 | Clifford |
| 4,551,199 | A | | 11/1985 | Weldon |
| 4,552,778 | A | | 11/1985 | Zimmer |
| 4,557,218 | A | | 12/1985 | Sievers |
| 4,559,243 | A | | 12/1985 | Pässler et al. |
| 4,562,097 | A | | 12/1985 | Walter et al. |
| 4,571,360 | A | | 2/1986 | Brown et al. |
| 4,576,112 | A | | 3/1986 | Funger et al. |
| 4,581,254 | A | | 4/1986 | Cunningham et al. |
| 4,597,831 | A | | 7/1986 | Anderson |
| 4,603,176 | A | | 7/1986 | Bjorkquist et al. |
| 4,605,702 | A | | 8/1986 | Guerro et al. |
| 4,612,874 | A | | 9/1986 | Mitter |
| 4,618,689 | A | | 10/1986 | Traver et al. |
| 4,646,675 | A | | 3/1987 | Arthur et al. |
| 4,655,056 | A | | 4/1987 | Zeiffer |
| 4,665,723 | A | | 5/1987 | Zimmer |
| 4,667,882 | A | | 5/1987 | Pacifici |
| 4,699,988 | A | | 10/1987 | Traver et al. |
| 4,731,092 | A | | 3/1988 | Berendt |
| 4,734,100 | A | | 3/1988 | Berendt et al. |
| 4,741,739 | A | | 5/1988 | Berendt et al. |
| 4,762,727 | A | | 8/1988 | Voswinckel |
| 4,773,110 | A | | 9/1988 | Hopkins |
| 4,778,477 | A | | 10/1988 | Lauchenauer |
| 4,792,619 | A | | 12/1988 | Berendt et al. |
| 4,799,278 | A | | 1/1989 | Beeh |
| 4,833,748 | A | | 5/1989 | Zimmer et al. |
| 4,872,325 | A | | 10/1989 | Moser et al. |
| 4,894,118 | A | | 1/1990 | Edwards et al. |
| 4,911,956 | A | | 3/1990 | Gabryszewski et al. |
| 4,912,948 | A | | 4/1990 | Brown et al. |
| 4,943,350 | A | | 7/1990 | Bogart et al. |
| 4,950,545 | A | | 8/1990 | Walter et al. |
| 5,008,131 | A | | 4/1991 | Bakhshi |
| 5,009,932 | A | | 4/1991 | Klett et al. |
| 5,048,589 | A | | 9/1991 | Cook et al. |
| 5,055,216 | A | * | 10/1991 | Johnson ..... 15/104.93 |
| 5,059,282 | A | | 10/1991 | Ampulski et al. |
| 5,085,920 | A | * | 2/1992 | Nohr et al. ..... 428/198 |
| 5,089,296 | A | | 2/1992 | Bafford et al. |
| 5,098,979 | A | | 3/1992 | O'Lenick, Jr. |
| 5,145,527 | A | | 9/1992 | Clifford et al. |
| 5,164,046 | A | | 11/1992 | Ampulski et al. |
| 5,165,261 | A | | 11/1992 | Cho |
| 5,215,626 | A | | 6/1993 | Ampulski et al. |
| 5,219,620 | A | | 6/1993 | Potter et al. |
| 5,227,023 | A | | 7/1993 | Pounder et al. |
| 5,227,242 | A | | 7/1993 | Walter et al. |
| 5,237,035 | A | | 8/1993 | O'Lenick, Jr. et al. |
| 5,245,545 | A | | 9/1993 | Taylor |
| 5,246,545 | A | | 9/1993 | Ampulski et al. |
| 5,246,546 | A | | 9/1993 | Ampulski |
| 5,328,565 | A | | 7/1994 | Rasch et al. |
| 5,328,685 | A | | 7/1994 | Janchitraponvej et al. |
| 5,340,609 | A | | 8/1994 | Arthur et al. |
| 5,366,161 | A | | 11/1994 | Potter et al. |
| 5,385,643 | A | | 1/1995 | Ampulski |
| 5,389,204 | A | | 2/1995 | Ampulski |
| 5,399,412 | A | | 3/1995 | Sudall et al. |
| 5,466,337 | A | | 11/1995 | Darlington et al. |
| 5,492,655 | A | | 2/1996 | Morton et al. |
| 5,505,997 | A | | 4/1996 | Strong et al. |
| 5,510,001 | A | | 4/1996 | Hermans et al. |
| 5,525,345 | A | | 6/1996 | Warner |
| 5,529,665 | A | | 6/1996 | Kaun |
| 5,538,595 | A | | 7/1996 | Trokhan et al. |
| 5,552,020 | A | * | 9/1996 | Smith et al. ..... 162/164.4 |
| 5,558,873 | A | | 9/1996 | Funk et al. |
| 5,573,637 | A | | 11/1996 | Ampulski et al. |
| 5,591,306 | A | | 1/1997 | Kaun |
| 5,591,309 | A | | 1/1997 | Rugowski et al. |
| 5,601,871 | A | | 2/1997 | Krzysik et al. |
| 5,605,719 | A | | 2/1997 | Tench et al. |
| 5,607,980 | A | | 3/1997 | McAtee et al. |
| 5,614,293 | A | * | 3/1997 | Krzysik et al. ..... 162/134 |
| 5,623,043 | A | | 4/1997 | Fost et al. |
| 5,624,676 | A | | 4/1997 | Mackey et al. |
| 5,635,191 | A | | 6/1997 | Roe et al. |
| 5,635,469 | A | | 6/1997 | Fowler et al. |
| 5,637,194 | A | | 6/1997 | Ampulski et al. |
| 5,643,588 | A | | 7/1997 | Roe et al. |
| 5,650,218 | A | * | 7/1997 | Krzysik et al. ..... 428/195.1 |
| 5,656,132 | A | | 8/1997 | Farrington, Jr. et al. |
| 5,665,426 | A | * | 9/1997 | Krzysik et al. ..... 427/211 |
| 5,667,636 | A | | 9/1997 | Engel et al. |
| 5,688,496 | A | | 11/1997 | Fost et al. |
| 5,705,164 | A | | 1/1998 | Mackey et al. |
| 5,707,434 | A | | 1/1998 | Halloran et al. |
| 5,707,435 | A | | 1/1998 | Halloran et al. |
| 5,725,736 | A | | 3/1998 | Schroeder et al. |
| 5,756,112 | A | | 5/1998 | Mackey |
| 5,792,737 | A | | 8/1998 | Gruning et al. |
| 5,807,956 | A | | 9/1998 | Czech |
| 5,814,188 | A | | 9/1998 | Vinson et al. |
| 5,830,483 | A | | 11/1998 | Seidel et al. |
| 5,840,403 | A | | 11/1998 | Trokhan et al. |
| 5,849,313 | A | | 12/1998 | Fost et al. |
| 5,856,544 | A | | 1/1999 | Czech et al. |
| 5,857,627 | A | | 1/1999 | Horwell et al. |
| 5,861,143 | A | | 1/1999 | Peterson et al. |
| 5,869,075 | A | | 2/1999 | Krzysik |
| 5,871,763 | A | | 2/1999 | Luu et al. |
| 5,882,573 | A | | 3/1999 | Kwok et al. |
| 5,885,697 | A | * | 3/1999 | Krzysik et al. ..... 162/127 |
| 5,893,965 | A | | 4/1999 | Trokhan et al. |
| 5,902,540 | A | | 5/1999 | Kwok |
| 5,904,298 | A | | 5/1999 | Kwok et al. |
| 5,904,809 | A | | 5/1999 | Rokman et al. |
| 5,925,469 | A | | 7/1999 | Gee |
| 5,932,068 | A | * | 8/1999 | Farrington et al. ..... 162/117 |
| 5,935,383 | A | | 8/1999 | Sun et al. |
| 5,981,044 | A | | 11/1999 | Phan et al. |
| 5,981,681 | A | | 11/1999 | Czech |
| 5,985,434 | A | | 11/1999 | Qin et al. |
| 5,990,377 | A | | 11/1999 | Chen et al. |
| 6,017,417 | A | | 1/2000 | Wendt et al. |
| 6,030,675 | A | | 2/2000 | Schroeder et al. |
| 6,033,723 | A | | 3/2000 | Kistler et al. |
| 6,054,020 | A | * | 4/2000 | Goulet et al. ..... 162/112 |
| 6,077,375 | A | | 6/2000 | Kwok |
| 6,080,686 | A | * | 6/2000 | Floyd ..... 442/102 |
| 6,090,885 | A | | 7/2000 | Kuo et al. |
| 6,103,128 | A | | 8/2000 | Koso et al. |
| 6,120,784 | A | | 9/2000 | Snyder, Jr. |
| 6,126,784 | A | * | 10/2000 | Ficke et al. ..... 162/184 |
| 6,132,803 | A | | 10/2000 | Kelly et al. |
| 6,136,147 | A | | 10/2000 | Edwards et al. |

| | | | | |
|---|---|---|---|---|
| 6,179,961 | B1 | 1/2001 | Ficke et al. | |
| 6,183,814 | B1 | 2/2001 | Nangeroni et al. | |
| 6,217,707 | B1 | 4/2001 | Garvey et al. | |
| 6,217,940 | B1 | 4/2001 | Kuni | |
| 6,224,714 | B1 | 5/2001 | Schroeder et al. | |
| 6,231,719 | B1 | 5/2001 | Garvey et al. | |
| 6,238,518 | B1 | 5/2001 | Rokman et al. | |
| 6,238,682 | B1 * | 5/2001 | Klofta et al. | 424/402 |
| 6,261,580 | B1 * | 7/2001 | Lehrter et al. | 424/402 |
| 6,306,408 | B1 | 10/2001 | Eichhorn et al. | |
| 6,322,604 | B1 | 11/2001 | Midkiff | |
| 6,395,957 | B1 | 5/2002 | Chen et al. | |
| 6,432,268 | B1 | 8/2002 | Burghardt | |
| 6,432,270 | B1 * | 8/2002 | Liu et al. | 162/164.4 |
| 6,495,151 | B1 * | 12/2002 | McAtee et al. | 424/402 |
| 6,514,383 | B1 | 2/2003 | Liu et al. | |
| 6,547,928 | B1 | 4/2003 | Barnholtz et al. | |
| 6,599,394 | B1 | 7/2003 | Liu et al. | |
| 6,607,783 | B1 | 8/2003 | Vander Heiden et al. | |
| 6,716,309 | B1 * | 4/2004 | Chuang et al. | 162/135 |
| 6,761,800 | B1 * | 7/2004 | Capizzi | 162/184 |
| 6,805,965 | B1 * | 10/2004 | Liu | 428/452 |
| 6,855,817 | B1 * | 2/2005 | Lyles | 536/25.4 |
| 6,896,766 | B1 * | 5/2005 | Sarbo et al. | 162/112 |
| 6,949,167 | B1 * | 9/2005 | Shannon et al. | 162/135 |
| 6,949,168 | B1 * | 9/2005 | Liu et al. | 162/184 |
| 6,951,598 | B1 * | 10/2005 | Flugge et al. | 162/164.4 |
| 2002/0028230 | A1 * | 3/2002 | Eichhorn et al. | 424/443 |
| 2002/0092635 | A1 | 7/2002 | Capizzi | |
| 2002/0112831 | A1 | 8/2002 | Barnholtz et al. | |
| 2002/0112835 | A1 | 8/2002 | Liu et al. | |
| 2002/0139500 | A1 | 10/2002 | Range et al. | |
| 2003/0032352 | A1 | 2/2003 | Chang et al. | |
| 2003/0056917 | A1 | 3/2003 | Jimenz | |
| 2003/0077314 | A1 * | 4/2003 | Shannon et al. | 424/443 |
| 2003/0112831 | A1 | 6/2003 | Williams | |
| 2003/0118847 | A1 | 6/2003 | Chuang et al. | |
| 2003/0118848 | A1 | 6/2003 | Liu | |
| 2003/0159796 | A1 | 8/2003 | Watzinger et al. | |
| 2003/0188839 | A1 | 10/2003 | Urscheler | |
| 2003/0188841 | A1 | 10/2003 | Buder et al. | |
| 2003/0221808 | A1 | 12/2003 | Capizzi | |
| 2004/0074622 | A1 * | 4/2004 | Liu et al. | 162/179 |
| 2004/0079502 | A1 * | 4/2004 | Capizzi | 162/135 |
| 2004/0084162 | A1 | 5/2004 | Shannon et al. | |
| 2004/0084165 | A1 | 5/2004 | Shannon et al. | |
| 2004/0086726 | A1 | 5/2004 | Moline et al. | |
| 2004/0118532 | A1 * | 6/2004 | Sarbo et al. | 162/109 |
| 2004/0118533 | A1 * | 6/2004 | Shannon et al. | 162/109 |
| 2004/0144507 | A1 * | 7/2004 | Shannon et al. | 162/9 |
| 2004/0234804 | A1 * | 11/2004 | Liu et al. | 428/537.5 |
| 2004/0250969 | A1 * | 12/2004 | Luu et al. | 162/123 |
| 2005/0133177 | A1 * | 6/2005 | Stralin et al. | 162/115 |

FOREIGN PATENT DOCUMENTS

| | | | |
|---|---|---|---|
| DE | 19711452 | | 9/1998 |
| EP | 0047908 | A1 | 3/1982 |
| EP | 0098362 | B1 | 1/1984 |
| EP | 0120472 | A1 | 10/1984 |
| EP | 0195458 | A1 | 9/1986 |
| EP | 0196576 | B1 | 10/1986 |
| EP | 0333212 | A2 | 9/1989 |
| EP | 0336439 | A2 | 10/1989 |
| EP | 0347153 | B1 | 12/1989 |
| EP | 0347154 | B1 | 12/1989 |
| EP | 0347176 | B2 | 12/1989 |
| EP | 0347177 | B1 | 12/1989 |
| EP | 0643083 | B1 | 3/1995 |
| EP | 1023863 | A1 | 2/2000 |
| EP | 1013823 | A1 | 6/2000 |
| EP | 1059032 | A1 | 12/2000 |
| EP | 1149947 | A2 | 10/2001 |
| EP | 1236827 | A1 | 9/2002 |
| WO | WO 9501478 | A1 | 1/1995 |
| WO | WO 9704171 | | 2/1997 |
| WO | WO 9840207 | A1 | 9/1998 |
| WO | WO 9840425 | A1 | 9/1998 |
| WO | WO 9913158 | A1 | 3/1999 |
| WO | WO 9919081 | | 4/1999 |
| WO | WO 0015907 | A1 | 3/2000 |
| WO | WO 0068503 | A1 | 11/2000 |
| WO | WO 0071177 | A1 | 11/2000 |
| WO | WO 0104416 | A1 | 1/2001 |
| WO | WO 0114631 | A1 | 3/2001 |
| WO | WO 0128337 | | 4/2001 |
| WO | WO 0129315 | | 4/2001 |
| WO | WO 0216689 | A2 | 2/2002 |
| WO | WO 0248458 | A1 | 6/2002 |
| WO | WO 03021037 | A1 | 3/2003 |

OTHER PUBLICATIONS

Article—*New technology to apply starch and other additives*, M. Foulger, J. Parisian, H. P. Didwania, and J. Taylor, Pulp & Paper Canada, vol. 100. No. 2, 1999, pp. 24-25.

Shannon, et al., U.S. Appl. No. 10/289,809, filed Nov. 6, 2002, Soft Tissue Products Containing Polysiloxane Having a High Z-Directional Gradient.

Flugge, et al., U.S. Appl. No. 10/289,562, filed Nov. 6, 2002, Hydrophobically Modified Cationic Acrylate Copolymer/Polysiloxane Blends and Use in Tissue.

Liu, et al., U.S. Appl. No. 10/441,143, filed May 19, 2003, Single Ply Tissue Products Surface treated with a Softening Agent.

PCT Search Report for PCT/US03/28239, Mar. 3, 2004.

* cited by examiner

SOFT PAPER PRODUCT INCLUDING BENEFICIAL AGENTS

RELATED APPLICATIONS

The present application is a divisional application of U.S. patent application Ser. No. 10/305,790 filed on Nov. 27, 2002 now U.S. Pat. No. 6,949,168.

BACKGROUND OF THE INVENTION

Consumers use paper-wiping products, such as facial tissues and bath tissues, for a wide variety of applications. Facial tissues are not only used for nose care but, in addition to other uses, may also be used as a general wiping product. Consequently, there are many different types of tissue products currently commercially available.

In some applications, tissue products are treated with polysiloxane lotions in order to increase the softness of the tissue. Adding silicone compositions to a tissue may impart improved softness to the tissue while maintaining the tissue's strength and while reducing the amount of lint produced by the tissue during use.

In some applications, tissue products may be treated with other beneficial agents as well. For example, in addition to softening agents such as polysiloxane lotions, other desirable agents may be added to a tissue in order to provide a benefit to the user. For example, vitamins, plant extracts, medications, antimicrobial compounds, and the like may also be added to the web in order to transfer the desired agent to the consumer upon use.

In the papermaking industry, various manufacturing techniques have been specifically designed to produce paper products which consumers find appealing. Manufacturers have employed various methods to apply chemical additives, such as silicone compositions and other beneficial agents, to the surface of a tissue web. Currently, one method of applying chemicals to the surface of a tissue web is the rotogravure printing process. A rotogravure printing process utilizes printing rollers to transfer chemicals onto a substrate. Chemicals that are applied to webs using the rotogravure printing process typically require the addition of water, surfactants, and/or solvents in order to prepare an emulsion to be printed onto the substrate. Such additions are not only costly but also increase wet-out time, drying time, and add process complexity.

Another method of applying chemical additives to the surface of a tissue web is spray atomization. Spray atomization is the process of combining a chemical with a pressurized gas to form small droplets that are directed onto a substrate, such as paper. One problem posed with atomization processes is that manufacturers often find it difficult to control the amount of chemical that is applied to a paper ply. Thus, a frequent problem with spray atomization techniques is that a large amount of over-spray is generated, which undesirably builds upon machinery as well as the surfaces of equipment and products in the vicinity of the spray atomizer. Furthermore, over-spray wastes the chemical being applied, and comprises a generally inefficient method of applying additives to a tissue web. Additionally, lack of control over the spray atomization technique also affects the uniformity of application to the tissue web.

In view of the above, a need exists in the industry for improving the method for application of chemical additives to the surface of a paper web.

Further, besides the above-mentioned difficulties in applying chemical additives to the surface of a paper web, some additives, such as softening agents, may also have a tendency to impart hydrophobicity to the treated paper web. Although hydrophobicity may be desirable in some applications, in other applications, increased hydrophobicity may adversely affect the product. For instance, increased hydrophobicity in a bath tissue may prevent the bath tissue from being wetted in a sufficient amount of time and prevent disintegration and dispersing when disposed in a commode or toilet. Hence, in some applications, it is difficult to find a proper balance between softness and absorbency, both of which are desirable attributes for tissues, particularly bath tissues.

Thus, a need also exists for a process of applying hydrophobic compositions to tissues for providing benefits to the tissue without increasing the hydrophibicity of the tissue beyond desirable limits.

SUMMARY OF THE INVENTION

In general, the present invention is directed to an improved process for applying compositions to paper webs, such as tissue webs, paper towels and wipers. The present invention is also directed to improved paper products made from the process.

The process of the present invention includes extruding a composition onto the surface of a paper web through a meltblown die. For instance, a paper web having a basis weight of less than about 60 gsm may be suitable for the present invention. The extruded composition is highly viscous and may form fibers as it is extruded, either continuous or discontinuous fibers, as desired. In one embodiment, the fibers may be attenuated fibers. In one embodiment, the composition may comprise between about 0.01% to about 30% of a beneficial agent and from about 70% to about 99% of a polysiloxane softener. In one embodiment, the composition may be a neat polysiloxane.

In one embodiment, the fibers may be deposited on the web surface so as to cover a portion of the total surface area. For instance, the fibers may cover between about 20% and about 80% of a surface of the web, more particularly between about 30% and about 50% of a surface of the web. In one embodiment, the fiber distribution can be heterogeneous across the surface of the web, with more fiber coverage in one area of the web and little or no fiber coverage in other areas.

The beneficial agents added to the web may be any beneficial agent, such as, for instance, aloe vera extract, vitamin E, petrolatum, or mixtures of beneficial agents. The polysiloxane softeners added to the web may be hydrophilic or hydrophobic polysiloxanes. In one embodiment, a single composition may be applied to the web consisting essentially of only polysiloxane softeners and beneficial agents. In general, the total add on rate to the web of the combined additives may be between about 0.05% and about 5% by weight of the web.

A composition applied to the web according to one embodiment of the present invention may be quite viscous, with a viscosity of at least about 1,000 cps. In one embodiment, the composition may have a viscosity of between about 1,000 cps and about 100,000 cps.

In one embodiment, loose fibers and lint may be removed from the surface of the web prior to deposition of the composition on the web.

The compositions of the present invention may be deposited onto the web surface with a meltblown die. In one embodiment, the die tips of the meltblown die may be protected from accumulation of dust and lint by the presence of an air boundary blocking device. In one embodiment, the die tips may be between about 0.5 inches and about 3 inches from the web surface as the composition is deposited on the web. In another embodiment, the die tips may be between about one and about two inches from the surface of the web as the composition is extruded onto the web. The meltblown die may generally include between about 2 and about 30 die tips per inch, more specifically between about 3 and about 20 die tips per inch.

In some embodiments, a composition may be deposited on both surfaces of the web. In order to properly align the web in the process, it may be desirous to guide the web by use of guide rolls which may contact the composition containing surface of the web immediately after the deposition process. In such embodiments, it may prove beneficial to clean the surface of the guide roll, such as with an oscillating brush or a vacuum box, to prevent build up of composition on the guide roll.

The paper products of the present invention may include a paper web formed of cellulosic fibers, at least one polysiloxane softener and, at least one beneficial agent, both of which may be applied to a surface of the web in the form of attenuated fibers. For example, the product may contain between about 0.001% and about 2% of the beneficial agent(s) by weight of the product, and between about 0.05% and about 3% of the polysiloxane softener(s) by weight of the product. The additives of the present invention may be applied to the surface of the web together, in a single composition or separately, as desired.

The product may contain a wide variety of combinations of various hydrophilic and/or hydrophobic polysiloxane softeners and beneficial agents.

In one embodiment, the products may have a wet out time of less than about 8 seconds, more specifically between about 4 and about 6 seconds.

The products of the present invention may be quite absorbent. For example, the products may have an absorbent capacity of between about 5 and about 20 times the weight of the dry product. In one embodiment, the product may have an absorbent capacity between about 8 and about 12 times the weight of the dry product.

BRIEF DESCRIPTION OF THE DRAWINGS

A full and enabling disclosure of this invention is set forth in this specification. The following Figures illustrate the invention.

Figure 1:
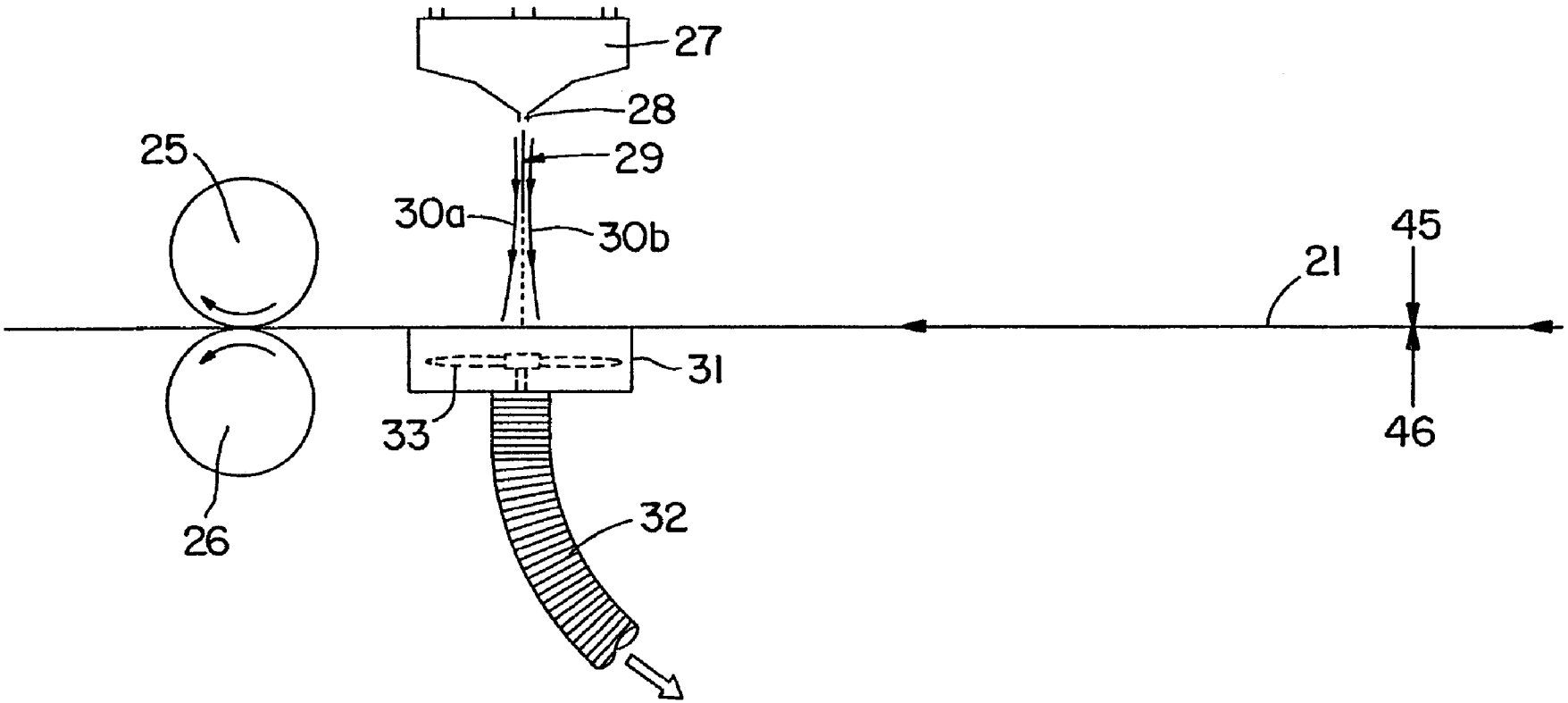
FIG. 1 is a schematic drawing showing application of a viscous composition through a meltblown die tip onto a paper web in accordance with the present invention.

Repeated use of reference characters in the present specification and drawings is intended to represent the same or analogous features of the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations may be made in the invention without departing from the scope or spirit of the invention. For instance, features illustrated or described as part of one embodiment may be used in another embodiment to yield a still further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied in the exemplary constructions.

In general, the present invention is directed to applying viscous chemical compositions through a meltblown die tip on to a paper web, such as a tissue web. It has been found by the present inventors that when compared with the rotogravure printing process and the spray atomizing process, the meltblown process is more efficient.

For example, in comparison to the rotogravure printing process, the process of the present invention for applying compositions to paper webs may be simpler and less complex. The process of the present invention also provides more flexibility with respect to operation parameters. For instance, it has been found that the process of the present invention provides better controls over flow rates and add on levels of the compositions being applied to the paper webs. In some applications, the process of the present invention may also allow the compositions to be applied to the paper webs at higher speeds in comparison to many rotogravure printing processes.

In comparison to spray atomization processes, the process of the present invention may provide greater control over application rates and may apply compositions to paper webs more uniformly. The process of the present invention also may better prevent against over application of the composition and may provide better controls over placement of the composition onto the web.

Another advantage to the process of the present invention is that the process is well suited to applying relatively high viscous chemical additives to paper webs. Thus, it has been discovered that additives may be applied to paper webs without first combining the additives with anything which could dilute the additives, e.g., solvents, surfactants, preservatives, antifoamers, and the like. As a result, the process of the present invention may be more economical and less complex than many conventional application systems.

In one embodiment, a composition containing a chemical additive in accordance with the present invention may be applied to a paper web in the form of fibers, such as, for instance, in the form or continuous fibers. Specifically, it has been discovered that under certain circumstances, compositions applied in accordance with the present invention will fiberize when extruded through the meltblown die tip. The ability to fiberize the compositions provides various advantages. For example, when formed into fibers, the composition is easily captured by the paper web. The fibers may also be placed on the web in specific locations. Further, when desired, the fibers will not penetrate through the entire thickness of the web, but instead, will remain on the surface of the web, where the chemical additives are intended to provide benefits to the consumer. For example, more than about 80% of the composition applied to the web in the form of fibers may remain on the surface of the treated web.

Another advantage of the present invention is that for some applications, a lesser amount of the chemical additive may be applied to the web than what was necessary in typical rotogravure processes while still obtaining an equivalent or better result. In particular, it is believed that since the chemical additive may be applied in a relatively viscous form without having to be formed into an emulsion or a solution and because the chemical additive may be applied as fibers uniformly over the surface of a web, it is believed that the same or better results may be obtained without having to apply as much of the chemical additive as was utilized in many prior art processes. For example, a softener may be applied to a web in a lesser amount while still obtaining the same softening effect in comparison to rotogravure processes and spray processes. In addition, the product also may have better wettability, as may be measured by wet-out time. Further, since less of the chemical additive is needed, additional cost savings are realized.

It has also been discovered that in some applications treating paper webs in accordance with the present invention may significantly increase the wet strength of the webs. For instance, when applying certain compositions such as hydrophobic compositions, it has been discovered that the treated paper web will have an improved cross direction wet:dry ratio. As used herein, the "wet:dry ratio" is the ratio of the wet tensile strength divided by the dry tensile strength. For paper webs treated in accordance with the present invention, the cross direction wet:dry ratio may increase by at least 25% particularly by at least 40%, and more particularly by at least 50%.

For instance, tissue webs treated in accordance with the present invention with a hydrophobic composition, such as a polysiloxane softener, may have a cross direction wet:dry ratio of at least 0.45, particularly at least 0.48, and more particularly at least 0.50. By applying a hydrophobic composition to the surface of a tissue web in the form of continuous filaments, the application of the composition may be heterogeneous across the web surface, such that a network of non-wettable tissue is formed that may provide significant strength when the tissue is wet, but still allow for excellent absorbency due to a large amount of uncoated tissue between the filaments.

In one aspect of the present invention, a composition containing a hydrophobic chemical additive is applied to a tissue, such as a bath tissue. The chemical additive, may be, for instance, a softener. By applying the hydrophobic composition in a heterogeneous manner on the tissue surface, a tissue may be produced not only having a lotiony, soft feel, but also having good wettability, even with the addition of the hydrophobic composition. In this manner, viscous hydrophobic compositions may be applied to bath tissues for improving the properties of the tissue without adversely affecting the wettability of the tissue.

In one embodiment of the present invention, more than one chemical additive may be combined and applied to a web. For example, a softener, such as a polysiloxane softener may be combined with one or more chemical agents which may provide a desired benefit to the consumer and then the combination may be applied to a paper web according to the present invention.

Possible beneficial agents that may be applied to paper webs in accordance with the present invention include, without limitation, anti-acne actives, antimicrobial actives, antifungal actives, antiseptic actives, antioxidants, cosmetic astringents, drug astringents, aiological additives, deodorants, emollients, external analgesics, film formers, fragrances, humectants, natural moisturizing agents and other skin moisturizing ingredients known in the art such as lanolin, opacifiers, skin conditioning agents, skin exfoliating agents, skin protectants, solvents, sunscreens, and surfactants. More specifically, vitamin E and aloe vera extracts are examples of beneficial agents which may be applied to a surface of a web according to the present inventive process.

The above chemical additives may be applied alone or in combination with other additives in accordance with the present invention. For example, the desired polysiloxane softeners may be mixed with the desired beneficial agents and applied together as a single composition. Alternatively, the softeners and beneficial agents may be applied separately, creating layers of additives on the surface of the paper web.

In one embodiment of the present invention, the process is directed to applying one or more softeners and one or more beneficial agents to a tissue web. The softener may be, for instance, a polysiloxane that makes a tissue product feel softer to the skin of a user. Suitable polysiloxanes that may be used in the present invention include amine, aldehyde, carboxylic acid, hydroxyl, alkoxyl, polyether, polyethylene oxide, and polypropylene oxide derivatized silicones, such as aminopolydialkylsiloxanes. When using an aminopolydialkysiloxane, the two alkyl radicals may be methyl groups, ethyl groups, and/or a straight branched or cyclic carbon chain containing from about 3 to about 8 carbon atoms. Some commercially available examples of polysiloxanes include WETSOFT CTW, AF-21, AF-23 and EXP-2025G of Kelmar Industries, Y-14128, Y-14344, Y-14461 and FTS-226 of the Witco Corporation, and Dow Corning 8620, Dow corning 2-8182 and Dow Corning 2-8194 of the Dow Corning Corporation.

In one embodiment, a polysiloxane softener of the following general chemical structure (hereinafter referred to as Structure 1) may be utilized in the process of the present invention:

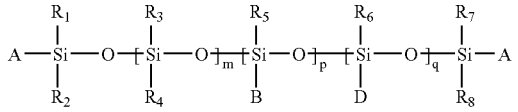

wherein,

A is hydrogen; hydroxyl; or straight chain, branched or cyclic, unsubstituted or substituted, $C_1$–$C_8$ alkyl or alkoxy radicals;

$R_1$–$R_8$ are independently, a straight chain, branched or cyclic, unsubstituted or substituted, $C_1$–$C_6$ alkyl radical;

m is from 20 to 100,000;

p is from 1 to 5,000;

q is from 0 to 5,000;

B is the following:

$$—R_9—[(OC_2H_5)_r—(OC_3H_7)_s]_t—G—(R_{10})_z—W$$

wherein, t=0 or 1;

z is 0 or 1;

r is from 1 to 50,000;

s is from 0 to 50,000;

$R_9$ is a straight chain, branched or cyclic, unsubstituted or substituted, $C_2$–$C_8$ alkylene diradical;

$R_{10}$ is a straight chain, branched or cyclic, unsubstituted or substituted, $C_2$–$C_8$ alkylene diradical or an alkyl cyclic ethereal radical;

G is oxygen or $NR_{11}$, where $R_{11}$ is hydrogen or a straight chain, branched or cyclic, unsubstituted or substituted, $C_1$ to $C_8$ alkyl radical;

when z=0, W is hydrogen or a straight chain, branched or cyclic, unsubstituted or substituted, $C_1$ to $C_{22}$ alkyl radical;

when z=1, W is hydrogen, an —$NR_{12}R_{13}$ radical, or an —$NR_{14}$ radical;

wherein, $R_{12}$ and $R_{13}$ are independently, hydrogen or a straight chain, branched or cyclic, unsubstituted or substituted, $C_1$–$C_8$ alkyl radical; and $R_{14}$ is a straight chain, branched or cyclic, unsubstituted or substituted, $C_3$ to $C_8$ alkylene diradical that forms a cyclic ring with the nitrogen;

D is the following:

$$—R_{15}—(OC_2H_5)_x—(OC_3H_7)_y—O—R_{16}$$

wherein, x is from 1 to 10,000;

y is from 0 to 10,000;

$R_{15}$ is a straight chain, branched or cyclic, unsubstituted or substituted, $C_2$–$C_8$ alkylene diradical, and $R_{16}$ is hydrogen or a straight chain, branched or cyclic, unsubstituted or substituted, $C_1$–$C_8$ alkyl radical.

Representative amino-functionalized species within the foregoing general Structure 1 include the following (the terms "EO" and "PO" refer to "ethylene oxide" and "propylene oxide" moieties, respectively):

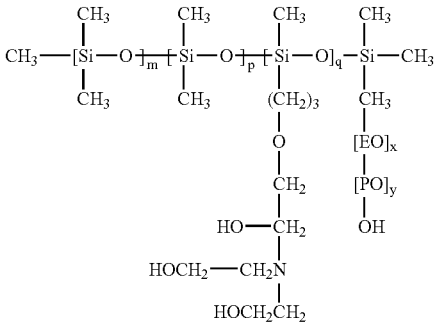

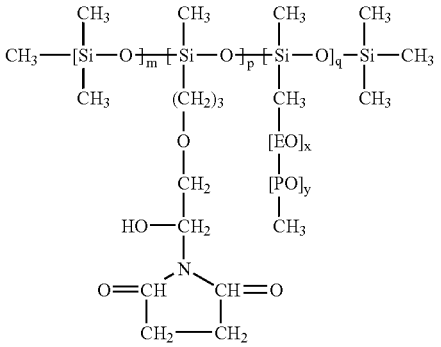

-continued

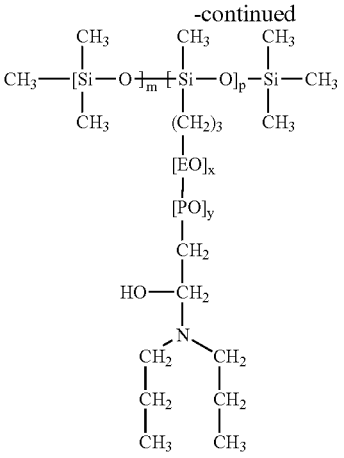

Moreover, in some embodiments, a polysiloxane having the following general structure (hereinafter referred to as Structure 2) may also be utilized in the present invention:

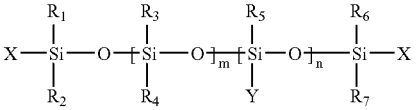

wherein,

X is hydrogen; hydroxyl; or straight chain, branched or cyclic, unsubstituted or substituted, $C_1$–$C_8$ alkyl or $C_1$–$C_8$ alkoxyl radical;

$R_1$–$R_7$ are independently, a straight chain, branched or cyclic, unsubstituted or substituted, $C_1$–$C_6$ alkyl radical;

m is 10 to 100,000;

n is 0 to 100,000;

Y is the following:

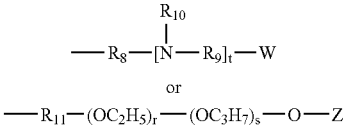

wherein, t is 0 or 1;

r is 10 to 100,000;

s is 10 to 100,000;

$R_8$, $R_9$, and $R_{11}$ are independently, a straight chain, branched or cyclic, unsubstituted or substituted, $C_2$–$C_8$ alkylene diradical;

$R_{10}$ is hydrogen or a straight chain, branched or cyclic, unsubstituted or substituted, $C_1$–$C_8$ alkyl radical;

W is the following:

$$—NR_{12}R_{13}$$

or $$—NR_{14}$$

wherein, $R_{12}$ and $R_{13}$ are independently, hydrogen or a straight chain, branched or cyclic, unsubstituted or substituted, $C_1$–$C_8$ alkyl radical, or an acyl radical; and $R_{14}$ is a straight chain, branched or cyclic, unsubstituted or substituted, $C_3$–$C_6$ alkylene diradical; and Z is hydrogen or a straight chain, branched or cyclic, unsubstituted or substituted, $C_1$–$C_{24}$ alkyl radical.

Representative species within the foregoing general structure (2) include the following (the terms "EO" and "PO" refer to "ethylene oxide" and "propylene oxide" moieties, respectively):

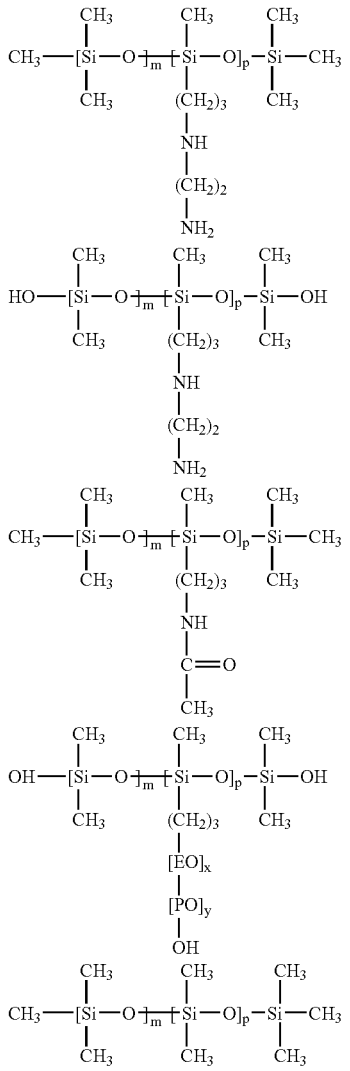

In the past, polysiloxanes were typically combined with water, preservatives, antifoamers, and surfactants, such as nonionic ethoxylated alcohols, to form stable and microbial-free emulsions and applied to tissue webs. Since the process of the present invention may accommodate higher viscosities, however, the polysiloxanes may be added directly to a tissue web or to another paper product without having to be combined with water, a surfactant or any other agent. For example, neat compositions, such as a neat polysiloxane composition or a neat beneficial agent may be applied to the surface of the web separately in any desired order in accordance with the present invention. In an alternative embodiment, a mixed composition including only a polysiloxane and a beneficial agent may be prepared and applied together in a single layer. Since the polysiloxane and the beneficial agents may be applied to a web without having to be combined with any other ingredients, the process of the present invention may be more economical and less complex than many prior processes. Further, as described above, it has also been discovered that lesser amounts of the chemical additives may be applied to the web while still obtaining the same or better results, which may provide additional cost savings.

In the past, polysiloxanes and other additives were also used sparingly in some applications due to their hydrophobicity. For instance, problems have been experienced in applying polysiloxane softeners to bath tissues due to the adverse impact upon the wettability of the tissue. By applying the polysiloxanes as fibers at particular areas on the web, however, it has been discovered that hydrophobic compositions may be applied to tissue webs for improving the properties of the webs while maintaining acceptable wettability properties. In particular, as will be described in more detail below, in one embodiment of the present invention, a hydrophobic composition may be applied in a discrete, discontinuous, or heterogeneous manner to a paper web in order to maintain a proper balance between improving the properties of the web through the use of the composition and maintaining acceptable absorbency and wettability characteristics. For instance, a composition may be applied to a surface of the web in such a fashion so as to apply varying amounts of the composition to the web at different surface locations. For example, the web may have composition in the form of fibers covering sections of the web, and no composition at other areas of the web, such as between the individual fibers which are extruded onto the web surface. In other words, the composition can cover the web in a heterogeneous fashion, with composition coverage varying across the surface of the web.

Referring to FIG. 1, one embodiment of a process in accordance with the present invention is illustrated. As shown, a tissue web 21 moves from the right to the left and is comprised of a first side 45 that faces upwards and a second side 46 that faces downward. The tissue web 21 receives a viscous composition stream 29 upon its first side 45.

In general, the composition stream 29 is applied to the web 21 after the web has been formed. The composition may be applied to the web, for instance, after the web has been formed and prior to being wound. Alternatively, the composition may be applied in a post treatment process in a rewinder system. As illustrated in FIG. 1, the web 21 may be calendared, using calendar rolls 25 and 26 subsequent to application of the composition. Alternatively, the web may be calendared and thereafter the composition may be applied to the web. The calendar rolls may provide a smooth surface for making the product feel softer to a consumer.

In this embodiment, a single composition containing one or more polysiloxane softeners combined with one or more beneficial agents is extruded to form a composition stream 29 that is directed onto the web 21. In general, any suitable extrusion device may be used in accordance with the present invention. In one embodiment, for instance, the extruder includes a meltblown die 27. A meltblown die is an extruder that includes a plurality of fine, usually circular, square or rectangular die capillaries or nozzles that may be used to form fibers. In one embodiment, a meltblown die may include converging high velocity gas (e.g. air) streams which may be used to attenuate the fibers exiting the nozzles. One example of a meltblown die is disclosed, for instance, in U.S. Pat. No. 3,849,241 to Butin, et al which is incorporated herein by reference.

As shown in FIG. 1, meltblown die 27 extrudes the viscous composition stream 29 from die tip 28. As illustrated, the meltblown die may be placed in association with air curtain 30*a–b*. The air curtain 30*a–b* may completely surround the extruded composition stream 29, while in other applications the air curtain 30*a–b* may only partially surround the composition stream 29. When present, the air curtain may facilitate application of the composition to the paper web, may assist in forming fibers from the composition being extruded and/or may attenuate any fibers that are being formed. Depending upon the particular application, the air curtain may be at ambient temperature or may be heated.

An exhaust fan 31 is located generally below the tissue web 21. The exhaust fan 31 is provided to improve air flow and to employ a pneumatic force to pull the composition stream 29 down on to the first side 45 of the tissue web 21. The exhaust fan 31 serves to remove from the immediate vicinity airborne particles or other debris through an exhaust duct 32. The exhaust fan 31 operates by pulling air using the rotating propeller 33 shown in dotted phantom in FIG. 1.

Figure 2:
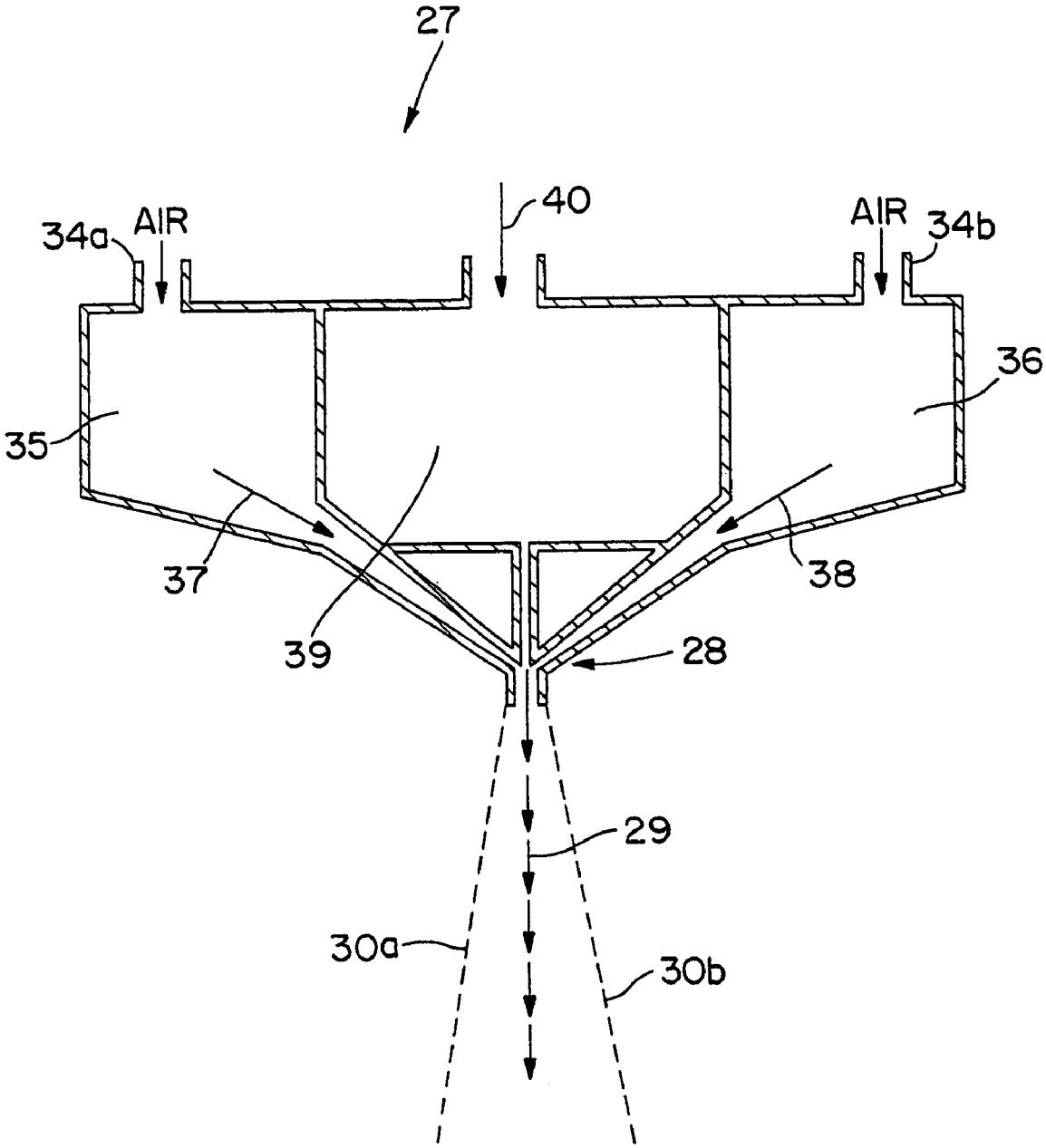
FIG. 2 is a side view of one embodiment of a meltblown die that may be used in accordance with the present invention.

In FIG. 2, a more detailed view of the meltblown die 27 is shown in which air intake 34*a–b* brings air into the meltblown die 27. Air travels into air duct 35 and air duct 36, respectively, from air intake 34*a* and 34*b*. The air proceeds along air pathway 37 and air pathway 38, respectively, to a point near the center of die tip 28 at which the air is combined with viscous composition 40 containing the desired polysiloxane softeners and beneficial agents that emerges from a reservoir 39 to die tip 28. Then, the composition travels downward as viscous composition stream 29, shielded by air curtain 30*a–b*.

Figure 3:
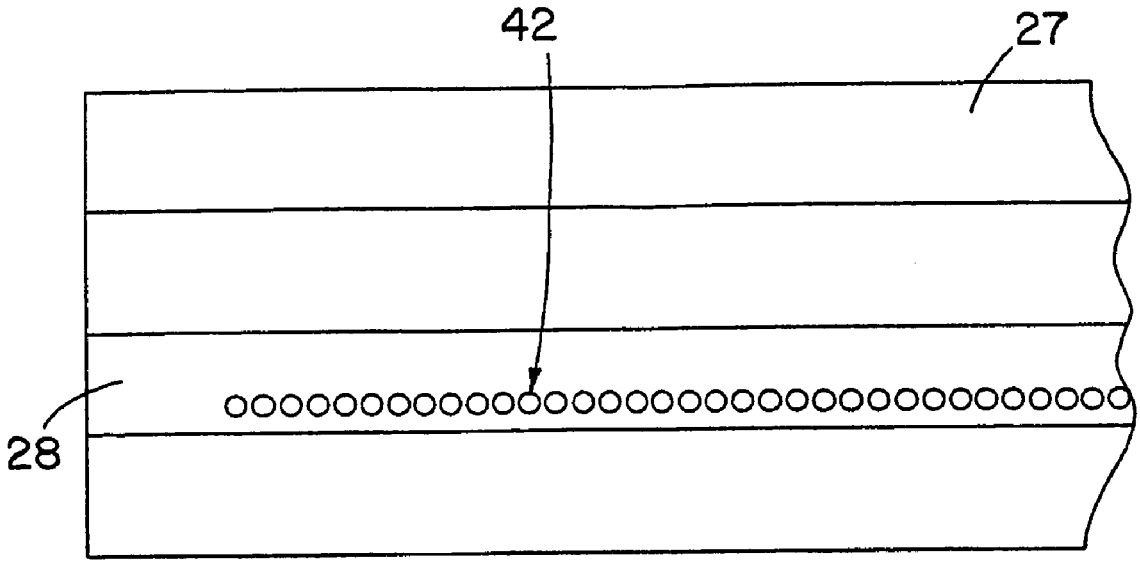
FIG. 3 is a bottom view of a portion of the meltblown die illustrated in FIG. 2 showing, in this embodiment, a row of nozzles through which compositions are extruded.

FIG. 3 shows a bottom view of the meltblown die 27 as it would appear looking upwards from the tissue web 21 (as shown in FIG. 1) along the path of the composition stream 29 to the point at which it emerges from die tip 28. In one embodiment, the meltblown die 27 is comprised of orifices 42 (several of which are shown in FIG. 3), and such orifices 42 may be provided in a single row as shown in FIG. 3. In other embodiments, there could be only a few scattered orifices 42; or perhaps, instead, a number of rows or even a series of channels could be used to release the composition stream 29 from meltblown die 27. In some cases, a combination of channels and orifices 42 could be used. In other cases, multiple rows of openings could be provided, and there is no limit to the different geometrical arrangement and patterns that could be provided to the meltblown die 27 for extruding a composition stream 29 within the scope of the invention.

In one specific embodiment of the invention, a pressurized tank (not shown) transfers a gas, such as air, to the meltblown die 27 for forcing the composition through the die tip. Composition 40 is forced through the meltblown die 27 and extruded through, for instance, holes or nozzles spaced along the length of the die tip. In general, the size of the nozzles and the amount of the nozzles located on the meltblown die tip may vary depending upon the particular application.

For example, the nozzles may have a diameter from about 5 mils to about 25 mils, and particularly from about 5 mils to about 10 mils. The nozzles may be spaced along the die tip in an amount from about 3 nozzles per inch to about 50 nozzles per inch, and particularly from about 3 nozzles per inch to about 20 nozzles per inch.

Two streams of pressurized air converge on either side of the composition stream 29 after it exits the meltblown die 27. The resulting air pattern disrupts the laminar flow of the composition stream 29 and attenuates the fibers being formed as they are directed onto the surface of the web. Different sized orifices or nozzles will produce fibers having a different diameter.

In general, the fibers that may be formed according to the present invention include discontinuous fibers and continuous fibers. The fibers may have various diameters depending upon the particular application. For instance, the diameter of the fibers may vary from about 5 microns to about 100 microns. In one embodiment, continuous fibers are formed having a diameter of about 25 microns.

Figure 5:
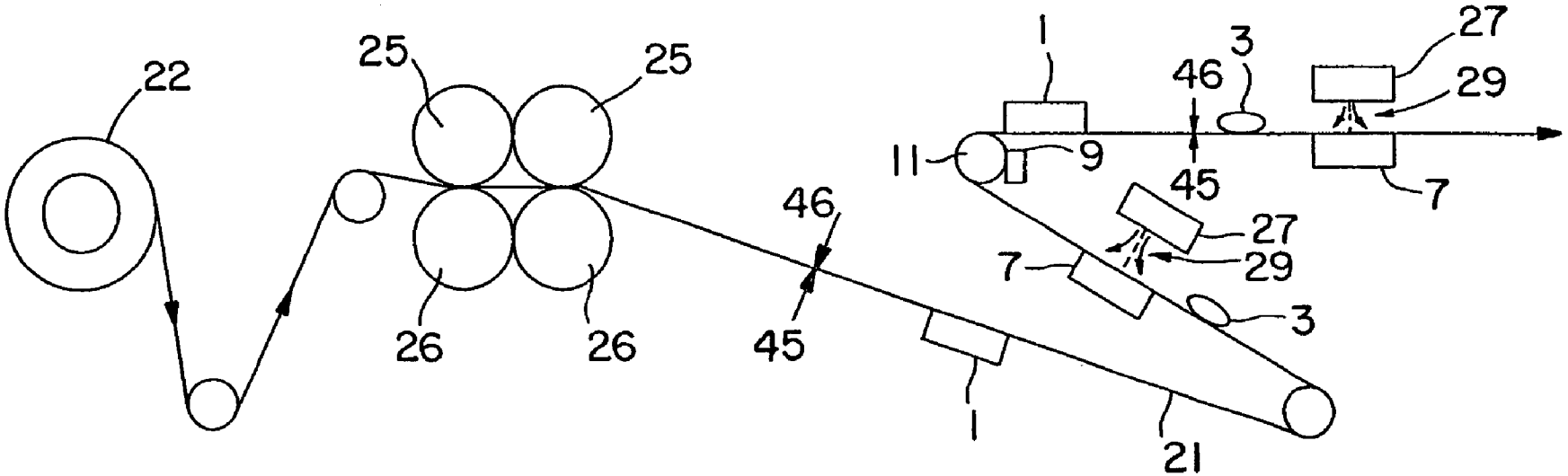
FIG. 5 illustrates one embodiment of the process of the present invention.

One embodiment of the process of the present invention is illustrated in FIG. 5. In this particular embodiment, the composition may be applied to both surfaces 45, 46 of a web 21 in a post treatment process. For example, the web 21 may be unwound from a roll 22. In this embodiment, the web is calendered using calendar rolls 25 and 26 prior to application of the composition. After being calendered, the web surface 45 which will be accepting the composition may be cleaned of loose fibers and lint by sheet cleaner 1 prior to application of the composition.

The compositions which may be applied to the surface of the web according to the present invention, whether neat compositions or mixtures, tend to be not only viscous, but also very tacky. For example, one embodiment of the present invention contemplates application of a neat polysiloxane composition, which is quite tacky. In addition, paper webs tend to carry a great deal of particulate matter, with a lot of lint and loose fibers associated with the base sheet. The combination of the tacky composition and the particulates associated with the paper web at the meltblown die may cause the die tips to become clogged and block the composition flow to the web. As such, the process and system of the present invention may prevent contact between particulate matter associated with the paper web and the die tips of the meltblown die and may therefore avoid the expense of down time of production due to clogged die tips.

Cleaning the surface of the web prior to application of the composition, such as at sheet cleaner 1, may prevent build up of lint and fibers at the die tips of the meltblown die 27. In the embodiment illustrated in FIG. 5, sheet cleaner 1 may be, for example, a vacuum system which may remove lint and loose fibers from the surface 45 of web 21 prior to application of the composition 29.

After the surface 45 of web 21 has been cleaned at sheet cleaner 1, a composition comprising the polysiloxane softener and, in one embodiment, the beneficial agent may be applied to the surface 45 of the web. In the illustrated embodiment, the composition may be applied by use of a meltblown die 27 which may extrude the composition stream and direct it to the surface of web 21. In an alternative embodiment, the different chemical additives may be applied to the surface of the web in separate steps, such as, for instance, with a series of meltblown dies, each extruding a different substance onto the surface of the web such that multiple layers of additive are built onto the web, wherein different layers comprise different additive compositions.

In order to further protect the die tips of the meltblown die 27 from build up of lint and loose fibers, the web 21 may pass through a boundary air blocking device 3 prior to reaching the meltblown die 27. A boundary air blocking device may be, for example, a stationary blocking device or a rotary blocking device which may deflect the flow of boundary air which may travel with the web and may carry lint and fiber which may clog the meltblown die tips.

The composition may be applied to the web 21 by use of meltblown die 27. In the embodiment wherein a meltblown die is used to extrude the composition onto the surface of the web, it has been discovered that the distance between the die tips and the web surface may be important not only for obtaining the desired coating pattern, but also for keeping lint and dust away from the die tips in order to prevent blockage of the composition flow. For instance, the die tips may be between about 0.5 inch and about 3 inches from the web surface 45 as the composition is applied to the web. In one embodiment, the die tips may be between about 1 inch and about 2 inches from the surface of the web during the application process.

The system of the present invention may also include a vacuum box 7. The vacuum box 7 is provided to improve air flow and to employ a pneumatic force to pull the composition stream 29 down on to the first side 45 of the tissue web 21.

Figure 6:
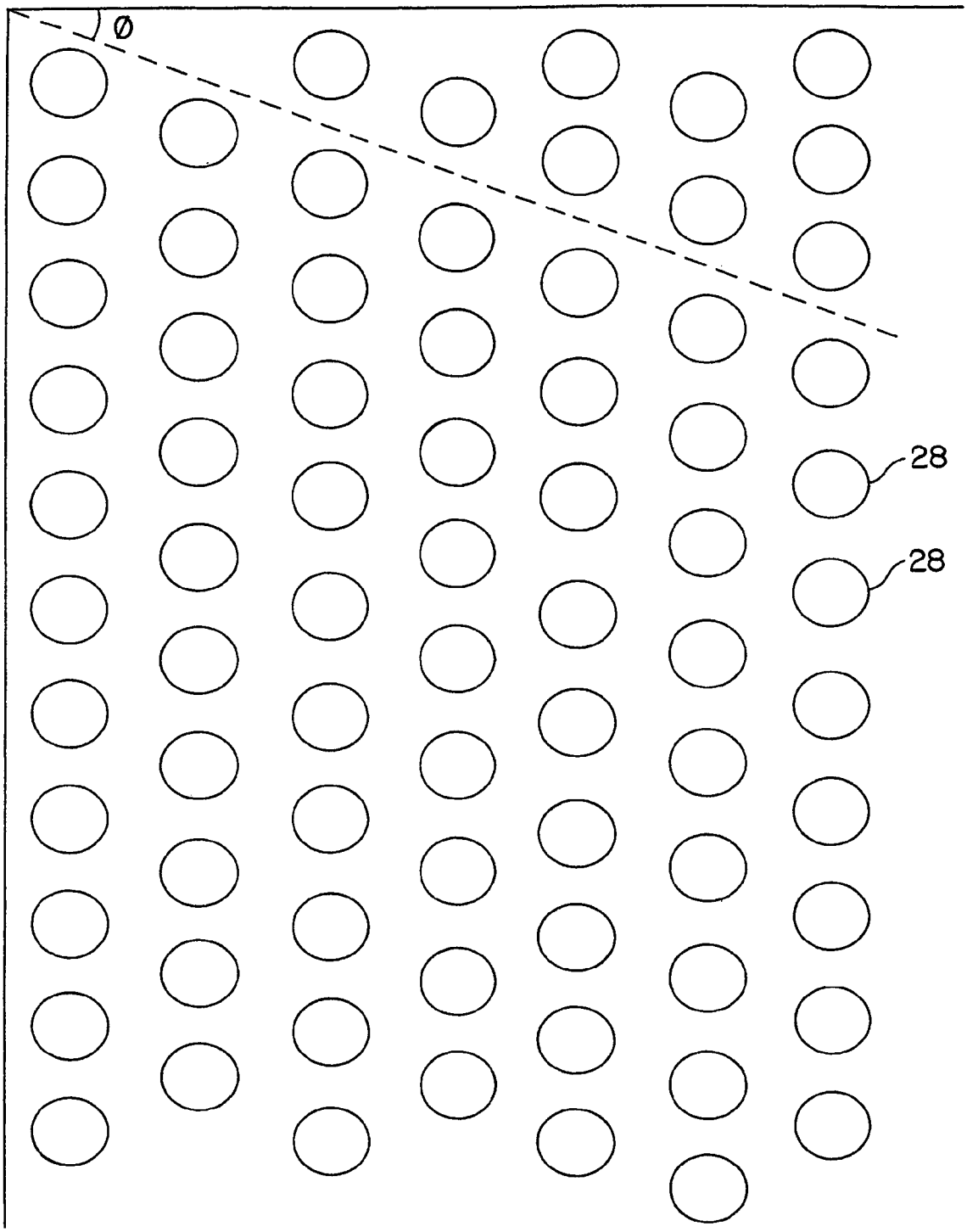
FIG. 6 is a top view of air intakes on a vacuum box which may be used in accordance with the present invention.

FIG. 6 shows a top view of the vacuum box 7 as it would appear looking down from the meltblown die 27 (as shown in FIG. 5). In this embodiment, the vacuum box 7 includes multiple air intakes 28 (several of which are shown in FIG. 6). As may be seen, the air intakes 28 are provided in a number of offset rows. In other embodiments, the air intakes 28 could be laid out with a different geometry, for instance a single row or even a series of channels to provide an air flow pulling the composition stream 29 from meltblown die 27 to the surface 45 of the web 21. In some cases, a combination of channels and air intakes 28 could be used. There is no limit to the patterns that could be provided to the air intakes 28 of the vacuum box 7 for providing the desired air flow.

In the embodiment illustrated in FIG. 6, multiple air intakes 28 are in the top of the vacuum box 7 in offset rows which are at an angle θ to the machine direction of the system. For example, the rows may be at an angle θ of between about 5° and about 30°. In one embodiment, the rows of air intakes 28 may be set at an angle from the machine direction of about 15°.

Air intakes 28 may have a diameter which may depend, among other things, on the web speed of the system. For example, at a web speed of between about 1,000 and about 3,000 feet/minute air intakes 28 may have a diameter of between about ¼ inch and about 1 inch. In one embodiment, air intakes 28 may have a diameter of between about one-half inch and about two-thirds inch.

Generally, suitable vacuum pressure may be placed on the web when the angled rows of air intakes 28 comprise between about 3 and about 30 individual intakes per row of 10-inch width. In one embodiment, the rows may comprise between about 6 and about 15 individual air intakes per row of 20-inch width. For instance, a single row may include 10 individual air intakes 28.

After the composition has been applied to the surface 45 of the web 21, the web may be guided around a roll 11 to be properly aligned for application of the composition to the second surface 46 of the web 21. In guiding the web 21 around the roll 11, the surface 45 which now carries fibers of the composition 29 will contact the roll 11. Some of the composition may stick to the roll 11 as the web 21 is guided around roll 11. In order to prevent build up of the composition on the surface of the guide roll 11, roll 11 may be cleaned with a roll cleaner 9. For example, a roll cleaner such as an oscillating brush or a vacuum device may be used to prevent build up of composition 29 on guide roll 11.

The second side 46 of web 21 may then be applied with the same or a different polysiloxane composition in a process similar to that used to apply the composition 29 to the first side 45 of the web 21. As shown, the second side of the web 46 may have excess lint and fibers removed at sheet cleaner 1 before having the composition 29 applied to the surface 46 of the web 21 with meltblown die 27. The melt blown die tips may be protected from blockage due to lint and fibers carried in the air boundary with air boundary blocking device 3. Vacuum box 7 may provide desired air flow and help direct the deposit of the composition fibers on the surface 46 of the web 21.

Referring again to FIG. 2, the flow rate of the composition 40 through the die 27 may be, for instance, from about 2 grams/inch to about 9 grams/inch in one embodiment. The flow rate will depend, however, on the composition being applied to the paper web, on the speed of the moving paper web, and on various other factors. In general, the total add on rate of the composition (including add on to both sides of the web if both sides are treated) may be up to about 10% based upon the weight of the paper web.

The polysiloxane softeners may be added to the web at a total add on rate of from about 0.05% to about 3% by weight of the paper web. The polysiloxane softeners may include one or more polysiloxane softeners according to Structure 1, described above, one or more polysiloxane softeners according to Structure 2, described above, or a combination of polysiloxanes of both Structure 1 and Structure 2. When more than one polysiloxane softener is applied to the web surface, they may be mixed together and applied at one time, or applied in separate steps, forming separate fibrous layers on the web surface, as desired.

In addition to the polysiloxane softener, the products of the present invention may also include one or more beneficial agents. The beneficial agents may be added to the web at a total add on rate of from about 0.001% to about 1% by weight of the paper web. As with the softeners, the beneficial agents may be mixed together and/or with the softeners for combined application, or applied separately, as desired.

In one embodiment, a single composition may be applied which comprises a combination of one or more polysiloxane softening agents and one or more beneficial agents. For instance, a single composition may be prepared including a polysiloxane softener according to Structure 1, above, Aloe Vera extract and Vitamin E. In one embodiment, the composition may be added to the web at an add on rate for the polysiloxane of between about 0.1% and about 1% by weight of the web, an add on rates for the Aloe of between about 0.01% and about 1% by weight of the web, and an add on rate for the vitamin E of between about 0.01% and about 1% by weight of the web.

In one embodiment, a single composition may be applied which comprises from about 0.01% to about 30% by weight of the beneficial agents and from about 70% to about 99.99% by weight of one or more polysiloxane softeners. In one embodiment, the composition may include only the softeners and the beneficial agents, with no other additives.

The product web may have the polysiloxane softeners and the beneficial agents applied to the surface of the web in a variety of different layered arrangements and combinations. For example, all of the desired topical applications may be premixed and applied to the surface of the web at once, such that all of the fibrous additive on one side of the web is essentially the same and contains both the desired polysiloxanes and the desired beneficial agents. Alternatively, the different agents may be applied in separate steps, creating layers of fibers on the surface of the web, each layer comprising different additives. In addition, some of the additives, for example two different beneficial agents, may be pre-mixed and applied to the web surface together, while the other desired additives may be applied in one or more separate steps and form separate layers of fibers on the web either above or below the others, as desired. Any possible combination of additives is envisioned according to the present invention.

The viscosity of the composition may also vary depending upon the particular circumstances. When it is desired to produce fibers through the meltblown die, the viscosity of the composition should be relatively high. For instance, the viscosity of the composition may be at least 1000 cps, particularly greater than about 2000 cps, and more particularly greater than about 3000 cps. For example, the viscosity of the composition may be from about 1000 to over 100,000 cps, such as from about 1000 cps to about 50,000 cps and particularly from about 2000 to about 10,000 cps.

As stated above, the purpose for air pressure or air curtain 30*a–b* on either side of the composition stream 29 (in selected embodiments of the invention) is to assist in the formation of fibers, to attenuate the fibers, and to direct the fibers onto the tissue web. Various air pressures may be used.

The temperature of the composition as it is applied to a paper web in accordance with the present invention may vary depending upon the particular application. For instance, in some applications, the composition may be applied at ambient temperatures. In other applications, however, the composition may be heated prior to or during extrusion. The composition may be heated, for instance, in order to adjust the viscosity of the composition. The composition may be heated by a pre-heater prior to entering the meltblown die or, alternatively, may be heated within the meltblown die itself using, for instance, an electrical resistance heater.

In one embodiment, the composition containing the chemical additive may be a solid at ambient temperatures (from about 20° C. to about 23° C.). In this embodiment, the composition may be heated an amount sufficient to create a flowable liquid that may be extruded through the meltblown die. For example, the composition may be heated an amount sufficient to allow the composition to be extruded through the meltblown die and form fibers. Once formed, the fibers are then applied to a web in accordance with the present invention. The composition may resolidify upon cooling.

Examples of additives that may need to be heated prior to being deposited on a paper web include compositions containing behenyl alcohol. Other compositions that may need to be heated include compositions that contain a wax, that contain any type of polymer that is a solid at ambient temperatures, and/or that contain a silicone.

The process of the present invention may be used to apply compositions and chemical additives to numerous and various different types of products. For most applications, however, the present invention is directed to applying chemical additives to paper products, particularly wiping products. Such products include facial tissues and bath tissues that have a basis weight of less than about 60 gsm, particularly from about 20 gsm to about 60 gsm, and more particularly from about 25 gsm to about 45 gsm. The tissue web may be made exclusively of pulp fibers or, alternatively, may contain pulp fibers mixed with other fibers.

In one embodiment, a hydrophobic composition is applied to a tissue web in accordance with the present invention while preserving the wettability and absorbency characteristics of the web. For example, many chemical additives that may be applied to tissue products are hydrophobic and thus when applied to a bath tissue across the surface of the tissue may adversely interfere with the ability of the tissue to become wet and disperse when being disposed of after use. For instance, various aminopolysiloxane softening agents when applied to a tissue may render a tissue unacceptable for use as a bath tissue due to the hydrophobic nature of the polysiloxane, although improving the softness and feel of the tissue.

In accordance with one embodiment of the present invention, however, hydrophobic compositions such as aminopolysiloxanes may be applied to tissue webs and other paper products without adversely interfering with the wettability of the web. In this embodiment of the present invention, the hydrophobic composition is applied to the web in a discontinuous manner, such that the coverage of the composition is heterogeneous across the web surface. For instance, in accordance with the present invention, the hydrophobic composition may be applied across the surface of the web yet be applied to contain various voids in the coverage for permitting the web to become wet when contacted with water. For example, in one embodiment, the hydrophobic composition is applied to the web as fibers that overlap across the surface of the web but yet leave areas on the web that remain untreated. In other applications, however, it should be understood that the viscous composition may be extruded onto the web so as to cover the entire surface area.

Figure 4:
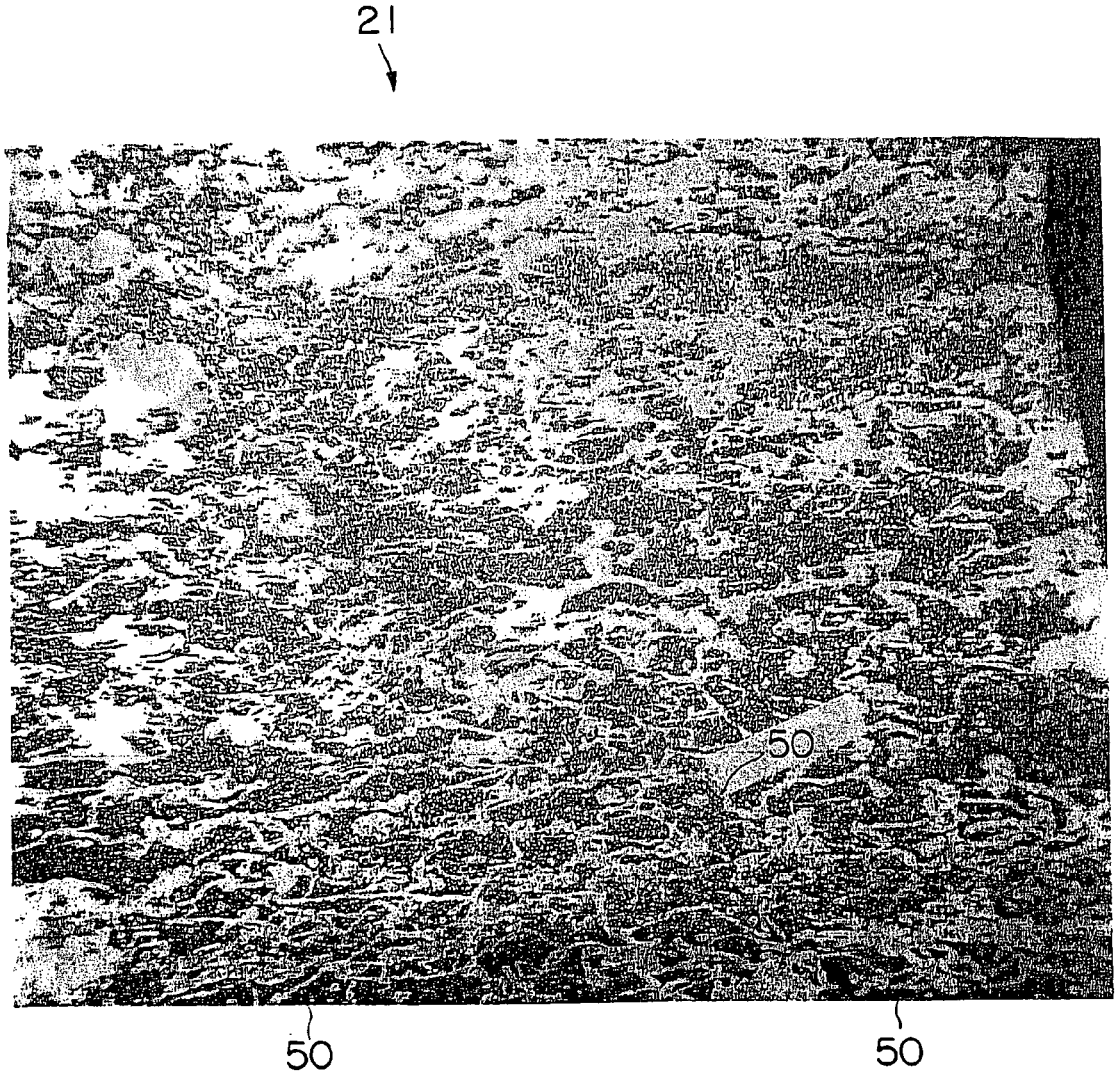
FIG. 4 is a plan view of one embodiment of a paper web made in accordance with the present invention.

Referring to FIG. 4, one embodiment of a paper web 21 treated in accordance with the present invention is shown. In this figure, the paper web is illustrated in a dark color to show the presence of fibers or filaments 50 appearing on the surface of the web. As shown, the filaments 50 intersect at various points and are randomly dispersed over the surface of the web. It is believed that the filaments 50 form a network on the surface of the web that increases the strength, particularly the wet strength and the geometric mean tensile strength of the web.

Geometric mean tensile strength (GMT) is the square root of the product of the machine direction tensile strength and the cross-machine direction tensile strength of the web. Tensile strength may be measured using an Instron tensile tester using a 3-inch jaw width (sample width), a jaw span of 2 inches (gauge length), and a crosshead speed of 25.4 centimeters per minute after maintaining the sample under TAPPI conditions for 4 hours before testing. The product webs of the present invention may have a geometric mean tensile strength of between about 500 g and about 1,000 g. In one embodiment, the webs of the present invention may have a geometric mean tensile strength of between about 650 g and about 800 g.

In the embodiment shown in FIG. 4, the filaments 50 only cover a portion of the surface area of the web 21. In this regard, the composition used to form the filaments may be applied to the web so as to cover from about 20% to about 80% of the surface of the web, and particularly from about 30% to about 60% of the surface area of the web. By leaving untreated areas on the web, the web remains easily wettable. In this manner, extremely hydrophobic materials may be applied to the web for improving the properties of the web while still permitting the web to become wet in an acceptable amount of time when contacted with water and maintain a high level of absorbency.

As used herein, a material is said to be "absorbent" if it may retain an amount of water equal to at least 100% of its dry weight. Absorbent Capacity refers to the amount of water that a saturated sample may hold relative to the dry weight of the sample and is reported as a dimensionless number (mass divided by mass).

A test for Absorbent Capacity may be performed according to Federal Government Specification UU-T-595b. It is made by cutting a 10.16 cm long by 10.16 cm wide (4 inch long by 4 inch wide) test sample, weighing it, and then saturating it with water for three minutes by soaking. The sample is then removed from the water and hung by one corner for 30 seconds to allow excess water to be drained off. The sample is then re-weighed, and the difference between the wet and dry weights is the water pickup of the sample expressed in grams per 10.16 cm long by 10.16 cm wide sample. The Absorbent Capacity value is obtained by dividing the total water pick-up by the dry weight of the sample. In general, the products of the present invention may have an Absorbent Capacity of between about 5 and about 20 times the weight of the dry paper product.

In one embodiment of the present invention, a hydrophobic softener may be applied to a bath tissue and still permit the bath tissue to disperse in water when disposed of. The softener, for instance, may be an aminopolydialkylsiloxane. In the past, when it has been attempted to apply softeners to bath tissue, typically a hydrophilically modified polysiloxane was used. The hydrophobic polysiloxanes, such as aminopolydialkylsiloxanes, however, not only have better softening properties, but are less expensive. Further, as described above, the process of the present invention allows lesser amounts of the additive to be applied to the tissue product while still obtaining the same or better results than many conventional processes.

One test that measures the wettability of a web is referred to as the "Wet Out Time" test. The Wet Out Time of paper webs treated in accordance with the present invention may be about 10 seconds or less, and more specifically about 8 seconds or less. For instance, paper webs treated in accordance with the present invention may have a Wet Out Time of about 6 seconds or less, still more specifically about 5 seconds or less, still more specifically from about 4 to about 6 seconds.

As used herein, "Wet Out time" is related to absorbency and is the time it takes for a given sample to completely wet out when placed in water. More specifically, the Wet Out Time is determined by cutting 20 sheets of the tissue sample into 2.5-inch squares. The number of sheets used in the test is independent of the number of plies per sheet of product. The 20 square sheets are stacked together and stapled at each corner to form a pad. The pad is held close to the surface of a constant temperature distilled water bath (23+/−2° C.), which is the appropriate size and depth to ensure the saturated specimen does not contact the bottom of the container and the top surface of the water at the same time, and dropped flat onto the water surface, staple points down. The time taken for the pad to become completely saturated, measured in seconds, is the Wet Out Time for the sample and represents the absorbent rate of the tissue. Increases in the Wet Out Time represent a decrease in the absorbent rate.

Any suitable tissue may be treated in accordance with the present invention. Further, a tissue product of the present invention may generally be formed by any of a variety of papermaking processes known in the art. In fact, any process capable of forming a paper web may be utilized in the present invention. For example, a papermaking process of the present invention may utilize adhesive creping, wet creping, double creping, embossing, wet-pressing, air pressing, through-air drying, creped through-air drying, uncreped through-drying, as well as other steps in forming the paper web.

Besides tissue products, however, the process of the present invention may also be applied to paper towels and industrial wipers. Such products may have a basis weight of up to about 200 gsm and particularly up to about 150 gsm. Such products may be made from pulp fibers alone or in combination with other fibers, such as synthetic fibers.

In one embodiment, various additives may be added to the composition in order to adjust the viscosity of the composition. For instance, in one embodiment, a thickener may be applied to the composition in order to increase its viscosity. In general, any suitable thickener may be used in accordance with the present invention. For example, in one embodiment, polyethylene oxide may be combined with the composition to increase the viscosity. For example, polyethylene oxide may be combined with a polysiloxane softener and a beneficial agent to adjust the viscosity of the composition to ensure that the composition will produce fibers when extruded through the meltblown die.

EXAMPLE

In order to further illustrate the present invention, a conventional polysiloxane formulation was applied to a through-dried tissue web using a rotogravure coater. For purposes of comparison, several different polysiloxane compositions were applied to the same bath tissue according to the present invention. In particular, neat polysiloxane compositions were fiberized using a uniform fiber depositor marketed by ITW Dynatec and applied in a discontinuous fashion to the tissue web.

More specifically, a single-ply, three-layered uncreped throughdried bath tissue was made using eucalyptus fibers for the outer layers and softwood fibers for the inner layer. Prior to pulping, a quaternary ammonium softening agent (C-6027 from Goldschmidt Corp.) was added at a dosage of 4.1 kg/metric ton of active chemical per metric ton of fiber to the eucalyptus furnish. After allowing 20 minutes of mixing time, the slurry was dewatered using a belt press to approximately 32% consistency. The filtrate from the dewatering process was either sewered or used as pulper make-up water for subsequent fiber batches but not sent forward in the stock preparation or tissue making process. The thickened pulp containing the debonder was subsequently re-dispersed in water and used as the outer layer furnishes in the tissue making process.

The softwood fibers were pulped for 30 minutes at 4 percent consistency and diluted to 3.2 percent consistency after pulping, while the debonded eucalyptus fibers were diluted to 2 percent consistency. The overall layered sheet weight was split 30%/40%/30% among the eucalyptus/refined softwood/eucalyptus layers. The center layer was refined to levels required to achieve target strength values, while the outer layers provided the surface softness and bulk. Parez 631NC was added to the center layer at 2–4 kilograms per ton of pulp based on the center layer.

A three layer headbox was used to form the web with the refined northern softwood kraft stock in the two center layers of the headbox to produce a single center layer for the three-layered product described. Turbulence-generating inserts recessed about 3 inches (75 millimeters) from the slice and layer dividers extending about 1 inch (25.4 millimeters) beyond the slice were employed. The net slice opening was about 0.9 inch (23 millimeters) and water flows in all four headbox layers were comparable. The consistency of the stock fed to the headbox was about 0.09 weight percent.

The resulting three-layered sheet was formed on a twin-wire, suction form roll, former with forming fabrics being Lindsay 2164 and Asten 867a fabrics, respectively. The speed of the forming fabrics was 11.9 meters per second. The newly-formed web was then dewatered to a consistency of about 20–27 percent using vacuum suction from below the forming fabric before being transferred to the transfer fabric, which was traveling at 9.1 meters per second (30% rush transfer). The transfer fabric was an Appleton Wire T807-1. A vacuum shoe pulling about 6–15 inches (150–380 millimeters) of mercury vacuum was used to transfer the web to the transfer fabric.

The web was then transferred to a throughdrying fabric (Lindsay wire T1205-1). The throughdrying fabric was traveling at a speed of about 9.1 meters per second. The web was carried over a Honeycomb throughdryer operating at a temperature of about 350° F., (175° C.) and dried to final dryness of about 94–98 percent consistency. The resulting uncreped tissue sheet was then wound into a parent roll.

The parent roll was then unwound and the web was calendered twice. At the first station the web was calendered between a steel roll and a rubber covered roll having a 4 P&J hardness. The calendar loading was about 90 pounds per linear inch (pli). At the second calendaring station, the web was calendered between a steel roll and a rubber covered roll having a 40 P&J hardness. The calender loading was about 140 pli. The thickness of the rubber covers was about 0.725 inch (1.84 centimeters).

A portion of the web was then fed into the rubber-rubber nip of a rotogravure coater to apply the a polydimethylsiloxane emulsion to both sides of the web. The aqueous emulsion contained 25% polydimethylsiloxane (Wetsoft CTW of Kelmar Industries); 8.3% surfactant; 0.75% antifoamer and 0.5% preservative.

The gravure rolls were electronically engraved, chrome over copper rolls supplied by Specialty Systems, Inc., Louisville, Ky. The rolls had a line screen of 200 cells per lineal inch and a volume of 6.0 Billion Cubic Microns (BCM) per square inch of roll surface. Typical cell dimensions for this roll were 140 microns in width and 33 microns in depth using a 130 degree engraving stylus. The rubber backing offset applicator rolls were a 75 shore A durometer cast polyurethane supplied by Amerimay Roller company, Union Grove, Wis. The process was set up to a condition having 0.375 inch interference between the gravure rolls and the rubber backing rolls and 0.003 inch clearance between the facing rubber backing rolls. The simultaneous offset/offset gravure printer was run at a speed of 2000 feet per minute using gravure roll speed adjustment (differential) to meter the polysiloxane emulsion to obtain the desired addition rate. The gravure roll speed differential used for this example was 1000 feet per minute. The process yielded an add-on level of 2.5 weight percent total add-on based on the weight of the tissue (1.25% each side).

Another portion or section of the formed tissue web was then fed through a uniform fiber depositor (UFD—a type of meltblown die) as described above. The uniform fiber depositor had 17 nozzles per inch and operated at an air pressure of 20 psi. The die applied a fiberized neat polysiloxane composition onto the web. The polysiloxanes used in this example included Wetsoft CTW, a polydimethylsiloxane of Kelmar Industries AF-23, a reactive aminoethylaminopropyl polysiloxane of Kelmar Industries EXP-2076, an alkoxy functional poly(dialkyl)siloxane of Kelmar Industries SWS-5000, a linear non-reactive poly(dialkyl)siloxane of Kelmar Industries. The polysiloxanes were added to the web to yield an add-on level as shown in Table 1, below.

After the webs were formed, each web was tested for Wet Out Time and for geometric mean tensile strength (GMT) as described above. In addition, the webs were tested for softness and stiffness values which were obtained through a Sensory Profile Panel testing method. A group of 12 trained panelists were given a series of tissue prototypes, one sample at a time. For each sample, the panelists rate the tissue for softness and stiffness on a letter grade scale, with A being the highest ranking. Results are reported as an average of panel rankings. The following results were obtained:

| Polysiloxane | Process | % Si | Wet Out Time | GMT | Stiffness | Softness |
|---|---|---|---|---|---|---|
| Wetsoft CTW | Rotogravure | 1.9 | 7.8 | 598 | B | B |
| AF-23 | UFD | 1.5 | 5.3 | 699 | A+ | A |
| Wetsoft CTW | UFD | 2.5 | 5.5 | 743 | A | A |
| Wetsoft CTW | UFD | 2 | 6.2 | 757 | A | A |
| Wetsoft CTW | UFD | 1.5 | 5.9 | 802 | A | B |
| EXP-2076 | UFD | 2.5 | 7.2 | 659 | A | B |
| EXP-2076 | UFD | 2 | 9.2 | 698 | A | B+ |
| EXP-2076 | UFD | 1.5 | 5.8 | 728 | A | A |
| SWS-5000 | UFD | 2.5 | 5.2 | 662 | A | B |
| SWS-5000 | UFD | 2 | 5.8 | 741 | B | B |
| SWS-5000 | UFD | 11.5 | 4.3 | 727 | A | A |
| SWS-5000 | UFD | 1 | 3.8 | 774 | A | B |

As shown above, the tissue samples treated with the uniform fiber deposition method generally had a shorter wet out time with a stronger geometric mean tensile strength and excellent stiffness and softness characteristics.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A process for applying a beneficial agent to a paper web comprising:

providing a paper web having a first surface and a second surface; and extruding a composition from a meltblown die onto the first surface, said composition having a viscosity sufficient for said composition to form attenuated fibers as said composition is extruded through said meltblown die and onto said first surface, said composition comprising from about 0.001% to about 30% by weight of a beneficial agent to provide at least one desired benefit to the consumer and from about 70% to about 99.99% by weight of one or more polysiloxane softeners; wherein the fibers are attenuated prior to being deposited onto the first surface.

2. The process of claim 1, wherein the composition is applied to the web in an amount from about 0.05% to about 5% by weight of said web.

3. The process of claim 1, wherein the beneficial agent is selected from the group consisting of aloe vera extract, vitamin E, petrolatum, and mixtures thereof.

4. The process of claim 1, wherein the polysiloxane softeners comprise a mixture of at least one hydrophilic polysiloxane softener and at least one hydrophobic polysiloxane softener.

5. The process of claim 1, wherein the polysiloxane softeners comprise at least one hydrophilic polysiloxane softener.

6. The process of claim 1, wherein the polysiloxane softeners comprise at least one hydrophobic polysiloxane softener.

7. The process of claim 1, wherein the composition has a viscosity between about 1,000 cps and about 100,000 cps.

8. The process of claim 1, wherein the composition has a viscosity of at least about 1,000 cps.

9. The process of claim 1, wherein the composition has a viscosity of between about 2,000 cps and about 10,000 cps.

10. The process of claim 1, wherein the composition consists essentially of said beneficial agent and said one or more polysiloxane softeners.

11. The process of claim 1, wherein the meltblown die tips are at a distance of from about 0.5 inches to about 3 inches away from the web surface as the composition is being extruded through the die tips.

12. The process of claim 11, wherein the die tips are between about one inch and about two inches away from the web surface as the composition is being extruded through the die tips.

13. The process of claim 1, wherein the fibers comprise continuous fibers.

14. The process of claim 1, wherein the paper web comprises a tissue web having a basis weight of less than about 60 gsm.

15. The process of claim 1, wherein the fibers exiting the meltblown die have a cross-sectional diameter of between about 5 and about 100 μm.

16. The process of claim 1, wherein the meltblown die comprises between about 2 and about 30 die tips per inch.

17. The process of claim 1, wherein the meltblown die comprises between about 3 and about 20 die tips per inch.

18. The process of claim 1, wherein the composition is extruded heterogeneously across the first surface of the web.

19. A process for producing a tissue web comprising:

forming a tissue web comprising a first side and a second side, said tissue web having a basis weight of less than about 60 gsm;

removing at least a portion of the loose fibers and lint from the first side of the tissue web; and extruding a first composition onto the first side of the tissue web, said first composition being extruded through a first meltblown die onto the web in a heterogeneous fashion, said first meltblown die being protected from accumulation of dust and lint at the die tips by an air boundary blocking device, said first composition having a viscosity sufficient for said first composition to form fibers as said first composition is extruded through said meltblown die and onto said web, the fibers being attenuated prior to being deposited onto said tissue web, said first composition comprising one or more polysiloxane softeners.

20. The process of claim 19, further comprising removing at least a portion of the loose fibers and lint from the second side of the tissue web and extruding a second composition onto the second side of the tissue web, said second composition being extruded through a second meltblown die onto the web in a heterogeneous fashion, said second meltblown die being protected from accumulation of dust and lint at the die tips by an air boundary blocking device, said second composition having a viscosity sufficient for said composition to form fibers as said second composition is extruded through said meltblown die and onto said web, the fibers being attenuated prior to being deposited onto said tissue web.

21. The process of claim 20, wherein said second composition comprises from about 0.001% to about 30% by weight of a beneficial agent to provide at least one desired benefit to the consumer and from about 70% to about 99.99% by weight of one or more polysiloxane softeners.

22. The process of claim 20, wherein the first composition and the second composition are essentially identical.

23. The process of claim 19, wherein the first composition comprises between about 0.001% and about 30% by weight of a beneficial agent and from about 70% to about 99.99% by weight of one or more polysiloxane softeners.

24. The process of claim 23, wherein the beneficial agent is selected from the group consisting of aloe vera extract, vitamin E, petrolatum, and mixtures thereof.

25. The process of claim 23, wherein the first composition consists essentially of the beneficial agent and one or more polysiloxane softeners.

26. The process of claim 19, wherein the first composition is extruded so as to cover between about 20% and about 80% of the surface of the first side of the tissue web.

27. The process of claim 19, wherein the first composition is extruded so as to cover between about 30% and about 50% of the surface of the first side of the tissue web.

28. The process of claim 19, wherein the first composition is applied to the web in an amount from about 0.18% to about 5% by weight of said web.

29. The process of claim 19, wherein the polysiloxane softeners comprise a mixture of at least one hydrophilic polysiloxane softener and at least one hydrophobic polysiloxane softener.

30. The process of claim 19, wherein the polysiloxane softeners comprise at least one hydrophilic polysiloxane softener.

31. The process of claim 19, wherein the polysiloxane softeners comprise at least one hydrophobic polysiloxane softener.

32. The process of claim 19, wherein the first composition has a viscosity between about 1,000 cps and about 100,000 cps.

33. The process of claim 19, wherein the first composition has a viscosity between about 2,000 cps and about 10,000 cps.

34. The process of claim 19, wherein the meltblown die tips are at a distance of from about 0.5 inches to about 3 inches away from the web surface as the composition is being extruded through the die tips.

35. The process of claim 19, wherein the meltblown die tips are between about one inch and about two inches away from the web surface as the composition is being extruded through the die tips.

36. The process of claim 19, wherein the tissue web has a basis weight between about 25 gsm and about 45 gsm.

37. The process of claim 19, wherein the fibers exiting the die tips are between about 5 and about 100 μm.

38. The process of claim 19, wherein the meltblown die comprises between about 3 and about 20 die tips per inch.

39. The process of claim 19, wherein the meltblown die comprises between about 4 and about 10 die tips per inch.

40. The process of claim 19, further comprising guiding the web around a guide roll after extruding the first composition onto the first side of the web, the first side of the web contacting the guide roll, the guide roll comprising a roll cleaner, the roll cleaner removing excess first composition from the guide roll.

41. The process of claim 40, wherein the roll cleaner comprises an oscillating brush.

42. The process of claim 40, wherein the roll cleaner comprises a vacuum box.

43. The process of claim 19, wherein at least a portion of the loose fibers and lint is removed from the first side of the web with a vacuum box.

* * * * *

UNITED STATES PATENT AND TRADEMARK OFFICE

CERTIFICATE OF CORRECTION

PATENT NO. : 7,101,460 B2
APPLICATION NO. : 11/232577
DATED : September 5, 2006
INVENTOR(S) : Kou-Chang Liu et al.

It is certified that error appears in the above-identified patent and that said Letters Patent is hereby corrected as shown below:

Title page, item (56) References Cited:

U.S. PATENT DOCUMENTS
Page 3, Ref. 2002/0139500 A1 10/2002 "Range, et al." should read -- Runge, et al --

Column 21, Line 67 (Claim 22), "are essentially identical" should read -- are identical --

Signed and Sealed this

Twelfth Day of December, 2006

JON W. DUDAS
*Director of the United States Patent and Trademark Office*